United States Patent [19]

Henricks et al.

[11] 4,053,330

[45] Oct. 11, 1977

[54] METHOD FOR IMPROVING FATIGUE PROPERTIES OF TITANIUM ALLOY ARTICLES

[75] Inventors: Robert Jacobi Henricks, Farmington; Duane Louis Ruckle, Enfield; Raymond Bender Slack, South Windsor, all of Conn.

[73] Assignee: United Technologies Corporation, Hartford, Conn.

[21] Appl. No.: 678,090

[22] Filed: Apr. 19, 1976

[51] Int. Cl.[2] ..... C22F 1/18

[52] U.S. Cl. ..... 148/11.5 F; 148/12.7 B

[58] Field of Search ..... 148/11.5 F, 12.7 B, 148/32, 32.5

[56] References Cited

U.S. PATENT DOCUMENTS

| | | | |
|---|---|---|---|
| 2,974,076 | 3/1961 | Vordahl | 148/12.7 B |
| 3,436,277 | 4/1969 | Bomberger, Jr. et al. | 148/12.7 B |
| 3,649,374 | 3/1972 | Chalk | 148/11.5 F |
| 3,748,194 | 7/1973 | Ruckle et al. | 148/12.7 B |
| 3,867,208 | 2/1975 | Grekov et al. | 148/12.7 B |
| 3,901,743 | 8/1975 | Sprague | 148/12.7 B |

*Primary Examiner*—W. Stallard

*Attorney, Agent, or Firm*—Charles E. Sohl

[57] ABSTRACT

A thermomechanical treatment to improve the fatigue strength of articles made from one of a class of alpha beta titanium alloys. The treatment involves heating the alloy into the beta field, hot deforming the alloy at a temperature within the beta field, rapidly quenching the alloy to room temperature to produce a hexagonal martensite structure and then tempering at an intermediate temperature so as to produce a structure in which discrete equiaxed beta phase particles are presented in an acicular alpha matrix. This structure is particularly resistant to the initiation and propagation of fatigue cracks.

3 Claims, No Drawings

METHOD FOR IMPROVING FATIGUE PROPERTIES OF TITANIUM ALLOY ARTICLES

BACKGROUND OF THE INVENTION

1. Field of the Invention

This invention relates to the field of thermal mechanical processes for the alpha/beta titanium alloys and the articles produced thereby.

2. Description of the Prior Art

The alpha/beta titanium alloys are well known in the art, and are described in the Metals Handbook, Vol. 1 (1961) at pp 1147–1156. These alloys, and various proceses applicable thereto are the subject of U.S. Pats. Nos. 2,801,167; 2,974,076; 3,007,824; 3,147,115; 3,405,016 and 3,645,803. In particular, U.S. Pat. Nos. 3,007,824 discloses a surface hardening process applicable to a specific alpha/beta alloy which involves heating the article at a temperature within the beta phase field and then quenching. No deformation is required. U.S. Pat. No. 3,405,016 discusses a heat treatment, for maximizing the formability of alpha/beta alloys, involving quenching from the beta phase field followed by deformation in the alpha/beta phase field.

The beta forging of the alpha/beta alloys is described in the Metals Handbook, Vol. 5 (1970) pp 143–144 wherein it is noted that beta forging as conventionally employed incorporates deformation both in the beta phase field and the alpha/beta phase field. The subject of beta forging is also discussed in Metals Engineering Quarterly, Vol. 8, Aug. 1968, at pp 10–15 and 15–18. These references imply that beta forging may have an adverse effect upon fatigue properties.

SUMMARY OF THE INVENTION

A class of titanium alloys, which contain both alpha and beta phase stabilizers, may be heat treated by the method of this invention to improve fatigue behavior. The process produces a fine grained acicular structure of alpha which contains equiaxed beta particles and this microstructure provides an improvement in fatigue properties. The process involves heating the alloy to a temperature wherein the structure is all beta, hot deforming the alloy to refine the beta structure, quenching the alloy to transform the beta structure into a martensite structure and tempering the martensite structure at an intermediate temperature to produce the desired microstructure having improved fatigue properties.

DESCRIPTION OF THE PREFERRED EMBODIMENTS

Titanium alloys are used in applications where a high ratio of mechanical properties to weight is important, and in many applications, the fatigue properties are the design limiting factor. Many commonly used titanium alloys are of the type which is termed alpha/beta, in which, at low temperatures the equilibrium microstructure consists of both the alpha and beta phases.

The invention process is broadly applicable to a wide variety of alpha/beta titanium alloys, those alloys which contain both alpha and beta stabilizers. The alpha stabilizers include but are not limited to aluminum, tin, nitrogen and oxygen while the beta stabilizers include but are not limited to the transition metals such as molybdenum, vanadium, manganese, chromium and iron as well as the nontransition metal copper. The process of this invention is most applicable to those alloys which have a room temperature equilibrium beta content of from about 5 to about 20 volume percent. Such alloys include but are not limited to Ti—6% Al—4% V; Ti—8% Al—1% Mo—1% V; Ti—6% Al—2% Sn—4% Zr—2% Mo; and Ti—6% Al—2% Sn—4% Zr—6% Mo.

The essential steps of the process are first, to heat the alloy article to a temperature within the beta phase field for the alloy in question, for example, above about 1825° F for Ti—6% Al—4% V, for a period of time suficient to permit the formation of a completely beta structure. The temperature above which the microstructure is all beta is also termed the beta transus. Usually the time in the beta field, after the achievement of thermal equilibrium, need not be greater than about 10 minutes.

Next the article is deformed at a temperature still within the beta field in an amount sufficient to refine the beta grain size, preferably to a size less than about 1 mm in diameter. Typically the amount of deformation required will be in the order of at least about 30% and preferably at least about 50%. Refinement of the beta grain size is desirable since the size of the martensite platelets which form during subsequent quenching will be controlled by the beta grain size and the size of the platelets has a significant effect on the alpha particle size in the tempered material. Following the hot deformation step the article is quenched at a rapid rate to a low temperature, for example, room temperature. Usually a liquid quench will be required, as for example water or oil. The rapid quenching is required to obtain the hexagonal martensite structure throughout essentially the entire article being quenched. Naturally the larger the article, the more severe will be the quench required to ensure that a completely martensite structure is produced throughout essentially the entire article being quenched. The time that elapses between the end of the hot deformation step and the quenching step is preferably limited to less than that which will permit significant beta grain growth.

The quenched article is preferably essentially all hexagonal martensite (a metastable phase), and upon tempering at an intermediate temperature, in the range of about 1000° to about 1600° F for a time between about 1 and about 24 hours, the hexagonal martensite structure will decompose to form a hexagonal alpha matrix, having a predominantly fine acicular morphology which contains discrete equiaxed beta phase particles having a body centered cubic structure. The morphology of the alpha/beta phase boundaries in the tempered structure produced by the present process is such that initiation and propagation of fatigue cracks occurs more slowly than in conventionally processed material.

Conventional processing of such alloys involves forging which may be conducted either below or above the beta transus temperature followed by heat treatments in the alpha beta field and by cooling to room temperature. Such processing results in a microstructure having retained platelets of beta in a matrix of alpha phase containing a mix of equiaxed and plate-like particles, the relative content of equiaxed and plate-like alpha particles being dependent on the forging and heat treatment temperatures. Evaluation of such conventionally processed alloys reveals that fatigue cracks initiate at boundaries between the alpha platelets and the retained beta platelets or in slip bands extending across large equiaxed or acicular alpha particles or across large colonies of similarly aligned acicular alpha particles. Because of the processing employed the alpha particles are large and the alpha/beta boundaries often extend for long distances. Also, large colonies of similarly aligned acicular alpha particles can be present. All of these factors operate to reduce the fatigue life of the material. The present process results in a novel fatigue resistant microstructure in which the size of alpha particles and of colonies of aligned acicular alpha platelets are minimized and in which the beta phase particles are discrete and equiaxed so that the maximum length of continuous alpha/beta phase boundaries are greatly lessened relative to the alpha/beta boundaries in conventionally processed material.

The process of the present invention is particularly suited for the fabrication of gas turbine engine parts such as compressor blades, vanes, discs and hubs. In many such applications it is the fatigue properties of the material which is the limiting design factor rather than other mechanical properties.

This invention will be clarified by references to the following illustrative example.

EXAMPLE

Two gas turbine engine compressor hub blanks made of Ti—6% Al—4% V (beta transus = 1825° F) were processed as described below and cut to produce samples for mechanical property evaluation. One hub was deformed using conventional processing parameters with a deformation of about 60% at a temperature of about 1750° F. Following the deformation, the hub was air cooled to room temperature, then aged at 1300° F for 2 hours and then air cooled to room temperature.

The second hub was processed according to the present invention, this hub was deformed 60% at a temperature of about 2150° F, water quenched, reheated at 1100° F for 4 hours and then air cooled. Identical fatigue samples were machined from the two hubs, and tested. The samples had a notch, acting as a stress concentrator and the value of KT for the sample was about 2.5.

The samples were tested at room temperature at a maximum load of 65 ksi and the results are shown in Table I.

TABLE I

| Process | Cycles to produce 1/32" crack | Cycles to Rupture |
|---|---|---|
| Invention Process (2150° water quench + 1100° /4 hrs) | [Test discontinued at 113,100 Cycles no cracks] | |
| Conventional Process (1750° + 1300° /2 hrs) | 25,000 | 31,000 |

Thus it may be seen that the invention process affords a significant improvement in fatigue properties. Table II shows the room temperature mechanical properties for the materials produced by the two processes.

TABLE II

| Invention Process | UTS (ksi) | .2% YS (ksi) | % Elong. | % RA |
|---|---|---|---|---|
| (2150° + 1100° /4 hrs) | 162.5 | 148.6 | 11.9 | 24 |
| Conventional Process (1750° + 1000° /2 hrs.) | 146.0 | 132.4 | 15.8 | 31.7 |

It can be seen that the invention process results in improved tensile properties with only a small decrease in ductility, relative to the conventional processing.

Although the invention has been shown and described with respect to a preferred embodiment thereof, it should be understood by those skilled in the art that various changes and omissions in the form and detail thereof may be made therein without departing from the spirit and the scope of the invention.

Having thus described a typical embodiment of our invention, that which we claim as new and desire to secure by Letters Patent of the U.S. is:

1. A thermomechanical process to improve the fatigue properties of titanium alloys of the class which contain both alpha and beta stabilizers and contain from about 5 to about 20 volume percent of the beta phase under equilibrium conditions at room temperature, including the steps of:

a. providing the alloy;

b. heating the alloy to a temperature above the beta transus for a period of time sufficient to produce a structure which is substantially all beta;

c. hot deforming the alloy at a temperature above the beta transus, an amount sufficient to refine the beta grain size;

d. rapidly quenching the alloy to produce an acicular martensitic structure;

e. tempering the martensite by reheating to an elevated temperature below the beta transus for a period of time sufficient to partially convert the martensite to acicular alpha, while permitting the formation of discrete equiaxed beta particles.

2. A process as in claim 1 wherein the tempering step is performed at a temperature of between about 1000° and 1600° F for a time of from about 1 to about 24 hours.

3. A process as in claim 1 wherein the alloy is chosen from the group consisting of T—6% Al—4% V, Ti—8% Al—1% Mo—1% V, Ti—6% Al—2% Sn—4% Zr—2% Mo and Ti—6% Al—2% Sn—4% Zr—6% Mo.

* * * * *

UNITED STATES PATENT OFFICE

CERTIFICATE OF CORRECTION

PATENT NO. : 4,053,330

DATED : October 11, 1977

INVENTOR(S) : ROBERT JACOBI HENRICKS ET AL

It is certified that error appears in the above-identified patent and that said Letters Patent are hereby corrected as shown below:

| | |
|---|---|
| In the Abstract, line 9 | "presented" should read -- present -- |
| Column 2, line 9 | "suficient" should read -- sufficient -- |
| Column 3, line 38 | "KT" should read -- $K_T$ -- |
| Column 4, line 48 | "T" should read -- Ti -- |

Signed and Sealed this

*Thirteenth* Day of *June 1978*

[SEAL]

*Attest:*

RUTH C. MASON
*Attesting Officer*

DONALD W. BANNER
*Commissioner of Patents and Trademarks*